US010302062B2

(12) United States Patent
Ishitani et al.

(10) Patent No.: US 10,302,062 B2
(45) Date of Patent: May 28, 2019

(54) IGNITION CONTROL APPARATUS

(71) Applicant: DENSO CORPORATION, Kariya, Aichi-pref. (JP)

(72) Inventors: Masahiro Ishitani, Kariya (JP); Akimitsu Sugiura, Kariya (JP); Makoto Toriyama, Kariya (JP); Satoru Nakayama, Kariya (JP); Yuuki Kondou, Kariya (JP); Hisaharu Morita, Kariya (JP); Naoto Hayashi, Kariya (JP); Yuuto Tamei, Kariya (JP); Takashi Oono, Kariya (JP); Shunichi Takeda, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/680,265

(22) Filed: Aug. 18, 2017

(65) Prior Publication Data

US 2017/0342955 A1 Nov. 30, 2017

Related U.S. Application Data

(63) Continuation of application No. 14/783,901, filed as application No. PCT/JP2014/060503 on Apr. 11, 2014, now Pat. No. 9,765,748.

(30) Foreign Application Priority Data

Apr. 11, 2013 (JP) ..... 2013-082960
Mar. 5, 2014 (JP) ..... 2014-043013

(51) Int. Cl.
*F02P 3/04* (2006.01)
*F02P 15/10* (2006.01)
*F02P 11/06* (2006.01)

(52) U.S. Cl.
CPC ..... *F02P 3/0435* (2013.01); *F02P 15/10* (2013.01); *F02P 11/06* (2013.01)

(58) Field of Classification Search
CPC ..... F02P 3/0435; F02P 15/10; F02P 11/06
See application file for complete search history.

(56) References Cited

U.S. PATENT DOCUMENTS 5,664,550 A 9/1997 Ito et al.
6,305,365 B1 10/2001 Maeoka et al.
(Continued)

FOREIGN PATENT DOCUMENTS

DE 10 2011 006 268 10/2012
EP 0 903 493 A2 3/1999
(Continued)

OTHER PUBLICATIONS

International Search Report (9 pages) dated Jul. 8, 2014 issued in Japanese Application No. PCT/JP2014/060503 and English translation (2 pages).
(Continued)

*Primary Examiner* — Joseph J Dallo
(74) *Attorney, Agent, or Firm* — Nixon & Vanderhye PC

(57) ABSTRACT

An ignition control apparatus of the present embodiment controls operation of an ignition plug provided so as to ignite an air-fuel mixed gas. The ignition control apparatus is characterized in that the ignition control apparatus includes: an ignition coil provided with a primary winding which allows a current to pass as a primary current therethrough and a second winding connected to the ignition coil, an increase and a decrease in the primary current generating a secondary current passing through the secondary winding; a DC power supply provided with a non-ground side output terminal, the non-ground side output terminal being connected to one end of the primary winding so that the primary current is made to pass through the primary winding; a first switching element configured of a semiconductor switching element provided with a first control terminal, a first power side terminal, and a first ground side terminal, the semiconductor switching element controlling on and off states of current supply between the first power side terminal and the
(Continued)

first ground side terminal based on a first control signal inputted to the first control terminal, the first power side terminal being connected to the other end side of the primary winding, the first ground side terminal being connected to a ground side; a second switching element configured of a semiconductor switching element provided with a second control terminal, a second power side terminal, and a second ground side terminal, the semiconductor switching element controlling on and off states of current supply between the second power side terminal and the second ground side terminal based on a second control signal inputted to the second control terminal, the second ground side terminal being connected to the other end side of the primary winding; a third switching element configured of a semiconductor switching element provided with a third control terminal, a third power side terminal, and a third ground side terminal, the semiconductor switching element controlling on and off states of current supply between the third power side terminal and the third ground side terminal based on a third control signal inputted to the third control terminal, the third power side terminal being connected to the second power side terminal of the second switching element, the third ground side terminal being connected to the ground side; and an energy accumulation coil configured of an inductor, the inductor being interposed in a power line connecting the non-ground side output terminal of the DC power supply and the third power side terminal of the third switching element, the energy accumulation coil accumulating energy therein in response to turning on of the third switching element.

9 Claims, 11 Drawing Sheets

(56) References Cited

U.S. PATENT DOCUMENTS

| | | | | |
|---|---|---|---|---|
| 6,705,302 | B2 | 3/2004 | Meinders | |
| 7,392,798 | B2 | 7/2008 | Wada | |
| 9,458,816 | B2 * | 10/2016 | Aida | F02P 15/00 |
| 2002/0109186 | A1 | 8/2002 | Kanekawa et al. | |
| 2004/0051160 | A1 | 3/2004 | Kanekawa et al. | |
| 2007/0175461 | A1 | 8/2007 | Wada et al. | |
| 2007/0181110 | A1 | 8/2007 | Toriyama et al. | |
| 2008/0127937 | A1 | 6/2008 | Toriyama et al. | |
| 2013/0263835 | A1 | 10/2013 | Eisen et al. | |
| 2014/0020666 | A1 | 1/2014 | Plotnikov | |
| 2014/0090628 | A1 * | 4/2014 | Aida | F02P 15/00 123/620 |
| 2015/0219062 | A1 | 8/2015 | Pawlak | |
| 2015/0292467 | A1 | 10/2015 | Forte | |
| 2016/0061177 | A1 | 3/2016 | Ishitani et al. | |

FOREIGN PATENT DOCUMENTS

| | | |
|---|---|---|
| EP | 1 233 447 A2 | 8/2002 |
| JP | 64-45963 | 2/1989 |
| JP | 5-172029 | 7/1993 |
| JP | 9-042129 | 2/1997 |
| JP | 2000-199470 | 7/2000 |
| JP | 2002-195143 | 7/2002 |
| JP | 2003-206844 | 7/2003 |
| JP | 2007-211631 | 8/2007 |
| JP | 2007-224795 | 9/2007 |
| JP | 2007-231927 | 9/2007 |
| JP | 2008-138639 | 6/2008 |
| JP | 2009-52435 | 3/2009 |
| JP | 4362675 | 8/2009 |
| JP | 2011-174471 | 9/2011 |
| JP | 2014-206061 | 10/2014 |
| JP | 2014-206068 | 10/2014 |
| JP | 2014-218995 | 11/2014 |
| JP | 2015-017562 | 1/2015 |
| WO | WO 2014/168243 | 10/2014 |
| WO | WO 2014/168244 | 10/2014 |
| WO | WO 2014/168248 | 10/2014 |
| WO | WO 2015/005245 | 1/2015 |
| WO | WO 2015/080270 | 6/2015 |

OTHER PUBLICATIONS

International Preliminary Report on Patentability (3 pages) dated Oct. 13, 2015 issued in Japanese Application No. PCT/JP2014/060503 and English translation (8 pages).

* cited by examiner

IGNITION CONTROL APPARATUS

CROSS-REFERENCE TO RELATED APPLICATIONS

This is a continuation of U.S. application Ser. No. 14/783,901, filed Oct. 12, 2015, which is the U.S. national phase of International Application No. PCT/JP2014/060503 filed 11 Apr. 2014 which designated the U.S. and claims priority to Japanese Patent Application Nos. 2013-082960, filed 11 Apr. 2013 and 2014-043013 filed 5 Mar. 2014, the entire contents of each of which are hereby incorporated by reference.

TECHNICAL FIELD

The present invention relates to an ignition control apparatus which controls operation of an ignition plug provided so as to ignite the air-fuel mixture gas in cylinders of an internal combustion.

BACKGROUND ART

In such an apparatus, to provide air-fuel mixture gas with a favorable combustion state, a configuration performing so-called multiple discharges is known. For example, Japanese Patent Laid-open publication No. 2007-231927 discloses a configuration in which a plural of electric discharges are continuously generated by a single combustion stroke. Meanwhile, Japanese Patent Laid-open publication No. 2000-199470 discloses a configuration in which two ignition coils are connected in parallel to obtain multiple discharge characteristics having a long discharge period.

SUMMARY OF INVENTION

Technical Problem

As disclosed in the configuration of Japanese Patent Laid-open publication No. 2007-231927, when a plurality of electric discharges are intermittingly generated in one combustion stroke, ignition discharge current repeatedly becomes zero in the period between the start and stop of the spark-ignition discharge in the combustion stroke. In this case, when the speed of gas flow in the cylinder is larger, so-called "blow off" occurs, which can cause a problem that ignition energy is lost. Meanwhile, Japanese Patent Laid-open publication No. 2000-199470 discloses a configuration in which two ignition coils are connected in parallel. In this configuration, the ignition discharge current does not repeatedly become zero in the period between the start and stop of the spark-ignition discharge in one stroke combustion. However, this apparatus becomes complex in configuration, and also becomes larger in size. Additionally, according to the configuration of the above conventional technique, since consumed energy is significantly greater than the energy required for ignition, electric power is uselessly consumed.

Solution to Problem

An ignition control apparatus of the present embodiment controls operation of an ignition plug provided so as to ignite an air-fuel mixed gas. The ignition control apparatus is characterized in that the ignition control apparatus includes: an ignition coil provided with a primary winding which allows a current to pass as a primary current therethrough and a second winding connected to the ignition coil, an increase and a decrease in the primary current generating a secondary current passing through the secondary winding; a DC power supply provided with a non-ground side output terminal, the non-ground side output terminal being connected to one end of the primary winding so that the primary current is made to pass through the primary winding; a first switching element configured of a semiconductor switching element provided with a first control terminal, a first power side terminal, and a first ground side terminal, the semiconductor switching element controlling on and off states of current supply between the first power side terminal and the first ground side terminal based on a first control signal inputted to the first control terminal, the first power side terminal being connected to the other end side of the primary winding, the first ground side terminal being connected to a ground side; a second switching element configured of a semiconductor switching element provided with a second control terminal, a second power side terminal, and a second ground side terminal, the semiconductor switching element controlling on and off states of current supply between the second power side terminal and the second ground side terminal based on a second control signal inputted to the second control terminal, the second ground side terminal being connected to the other end side of the primary winding; a third switching element configured of a semiconductor switching element provided with a third control terminal, a third power side terminal, and a third ground side terminal, the semiconductor switching element controlling on and off states of current supply between the third power side terminal and the third ground side terminal based on a third control signal inputted to the third control terminal, the third power side terminal being connected to the second power side terminal of the second switching element, the third ground side terminal being connected to the ground side; and an energy accumulation coil configured of an inductor, the inductor being interposed in a power line connecting the non-ground side output terminal of the DC power supply and the third power side terminal of the third switching element, the energy accumulation coil accumulating energy therein in response to turning on of the third switching element.

BRIEF DESCRIPTION OF DRAWINGS

FIG. 7 is a diagram showing an example of a circuit configuration around a first switching element shown in FIG. 2 and the like;

FIG. 8 is a diagram showing another example of the circuit configuration around the first switching element shown in FIG. 2 and the like;

DESCRIPTION OF THE EMBODIMENTS

Hereinafter, embodiments of the present invention are described with reference to the drawings.

<Engine System Configuration>

Figure 1:
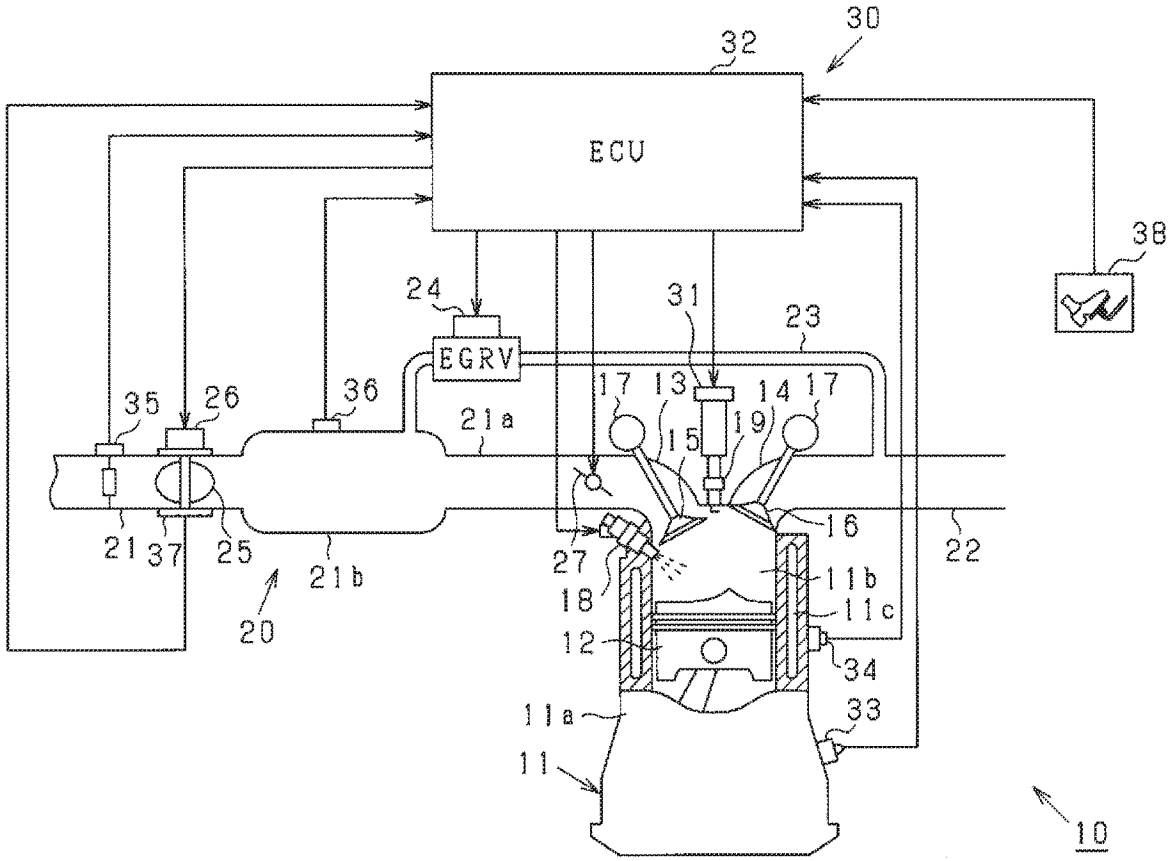
FIG. 1 is a diagram showing a schematic configuration of an engine system including a configuration of an embodiment of the present invention.

With reference to FIG. 1, an engine system 10 includes an engine 11 that is a spark ignition type internal combustion engine. A cylinder 11*b* and a water jacket 11*c* are formed inside an engine block 11*a*, which configures a main body of the engine 11. The cylinder 11*b* is provided so as to accommodate a piston 12 which can reciprocate. The water jacket 11*c* is a space in which a cooling liquid (also referred to as cooling water) can flow, and is provided so as to surround the cylinder 11*b*.

A suction port 13 and an exhaust port 14 are provided to a cylinder head which is an upper part of the engine block 11*a*, so as to communicate with the cylinder 11*b*. In addition, an intake valve 15, an exhaust valve 16, and a valve driving mechanism 17 are provided to the cylinder head. The intake valve 15 controls a communication state of the suction port 13 and the cylinder 11*b*. The exhaust valve 16 controls a communication state of the exhaust port 14 and the cylinder 11*b*. The valve driving mechanism 17 opens and closes the intake valve 15 and the exhaust valve 16 at predetermined timing.

Additionally, the engine block 11*a* is equipped with an injector 18 and an ignition plug 19. In the present embodiment, the injector 18 is provided so as to directly inject fuel into the cylinder 11*b*. The ignition plug 19 is provided so as to ignite air-fuel mixture gas in the cylinder 11*b*.

A supply and exhaust system 20 is connected to the engine 11. In the supply and exhaust system 20, three types of gas passages are provided which include an intake pipe 21 (including an intake manifold 21*a* and a surge tank 21*b*), an exhaust pipe 22, and an EGR passage 23.

The intake manifold 21*a* is connected to the suction port 13. The surge tank 21*b* is disposed on the upstream side in the intake air flow direction with respect to the intake manifold 21*a*. The exhaust pipe 22 is connected to the exhaust port 14.

The EGR (Exhaust Gas Recirculation) passage 23 is connected with the exhaust pipe 22 and the surge tank 21*b* so as to introduce part of the exhaustion gas exhausted to the exhaust pipe 22. An EGR control valve 24 is interposed in the EGR pathway 23. The EGR control valve 24 is provided so that an EGR rate (mixed proportion of exhausted gas of gas before combustion taken into the cylinder 11*b*) can be controlled by the opening thereof.

A throttle valve 25 is interposed on the upstream side in the intake air flow direction with respect to the surge tank 21*b*. The opening of the throttle valve 25 is regulated by the operation of a throttle actuator 26 including such as a DC motor. In addition, an air-flow control valve 27 is provided in the vicinity of the intake-port 13 to generate a swirl-flow or tumble-flow.

An ignition control apparatus 30 is provided in the engine system 10. The ignition control apparatus 30 controls operation of the ignition plug 19 (that is, performs ignition control of the engine 11). The ignition control apparatus 30 includes an ignition circuit unit 31 and an electronic control unit 32.

The ignition circuit unit 31 generates a spark discharge in the ignition plug 19 to ignite air-fuel mixture gas in the cylinder 11*b*. The electronic control unit 32 is a so-called engine ECU (Electronic Control Unit). The electronic control unit 32 controls operation of each component including the injector 18 and the ignition circuit unit 31, according to the acquired operation state of the engine 11 (hereinafter, referred to as "engine parameter") based on outputs of various sensors, such as the rotation speed sensor 33.

For the ignition control, the electronic control unit 32 generates and outputs an ignition signal IGt and an energy input period signal IGw, based on acquired engine parameters. The ignition signal IGt and the energy input period signal IGw specify an optimum ignition period and discharge current (ignition discharge current) depending on the gas state in the cylinder 11*b* and the required output of the engine 11 (which changes depending on the engine parameters). Note that since the signals are already known or well-known, further detailed descriptions of these signals are omitted in this specification (if necessary refer to Japanese Patent Laid-open publication No. 2002-168170, Japanese Patent Laid-open publication No. 2007-211631, and the like).

The rotation speed sensor 33 is a sensor for detecting (acquiring) an engine rotation speed Ne (also referred to as engine speed). The rotation speed 33 is mounted on engine block 11 so as to generate a pulsed output corresponding to the rotation angle of the rotating crack shaft, not show, which rotates in association with the reciprocating movement of the piston 12. A cooling water sensor 34 detects (acquires) a cooling water temperature Tw which is a temperature of the cooling liquid flowing through the water jacket 11*c*, and is mounted on the engine block 11*a*.

An air flow-meter 35 is a sensor for detecting (acquiring) the amount of intake air Ga (mass flow rate of intake air introduced into the cylinder 11*b* flowing from the intake pipe 21). The air flow meter 35 is mounted on the air-intake pipe 21 on the upstream side in the intake air flow direction with respect to the throttle valve 25. An intake pressure sensor 36 is a sensor for detecting (acquiring) an intake pressure Pa which is a pressure in the intake pipe 21, and is mounted on the surge tank 21*b*.

A throttle opening sensor 37 is a sensor for generating an output corresponding to the opening of the throttle valve 25 (throttle opening THA), and is included in the throttle actuator 26. An accelerator position sensor 38 is provided so as to generate an output corresponding to a manipulated variable of the accelerator (accelerator manipulated variable ACCP), not shown.

<Configuration of Ignition Control Apparatus of First Embodiment>

Figure 2:
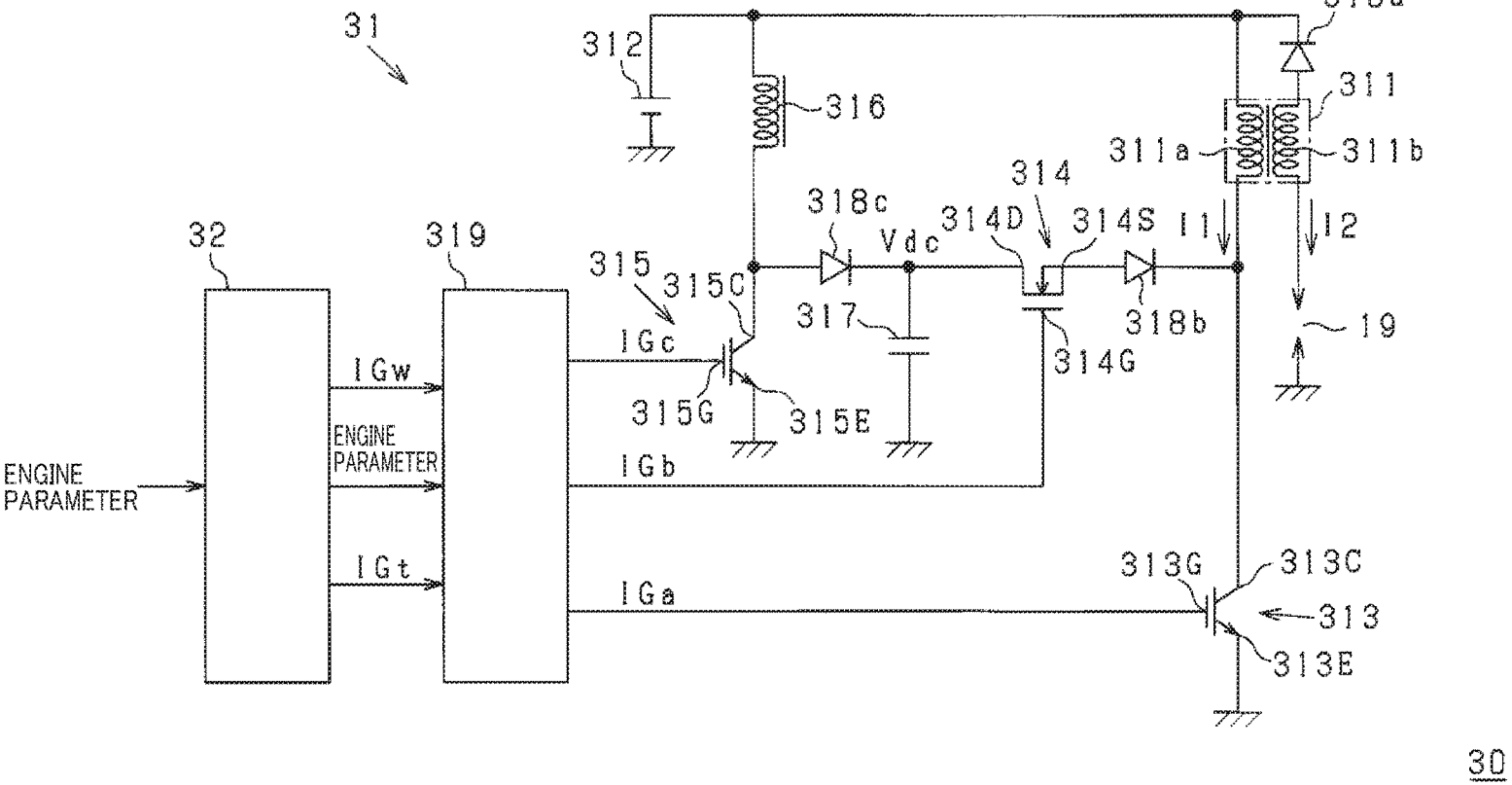
FIG. 2 is a schematic circuit diagram according to a first embodiment of an ignition control apparatus shown in FIG. 1.

With reference to FIG. 2, the ignition circuit unit 31 according to the first embodiment includes an ignition coil 311 (including a primary winding 311*a* and a secondary winding 311*b*), a DC power supply 312, a first switching element 313, a second switching element 314, a third switching element 315, an energy accumulation coil 316, a capacitor 317, diode 318*a*, 318*b* and 318*c*, and a driver circuit 319.

As described above, the ignition coil 311 includes a primary winding 311*a* and a secondary winding 311*b*. As is known, the ignition coil 311 generates a secondary current at the secondary winding 311*b* by increasing and decreasing a primary current flowing through the primary winding 311*a*.

On the side of a high voltage side terminal (also referred to as non-ground side terminal), which is one terminal of the primary winding 311*a*, a non-ground side output terminal (specifically, +terminal) of the DC power supply 312 is connected. Meanwhile, the side of a low voltage side terminal (also referred to as ground side terminal), which is the other terminal of the primary winding 311*a*, is connected to the ground side through the first switching element 313. That is, when the first switching element 313 is turned on, the DC power supply 312 makes a primary current flow from the side of the high voltage side terminal to the side of the low voltage side terminal in the primary winding 311*a*.

The side of the high voltage side terminal (also referred to as non-ground side terminal) of the secondary winding 311*b* is connected to the side of the high voltage side terminal of the primary winding 311*a* through the diode 318*a*. The diode 318*a* prohibits a current from flowing in the direction from the side of the high voltage side terminal of the primary winding 311*a* toward the side of the high voltage side terminal of the secondary winding 311*b*. In addition, the diode 318*a* regulates a secondary current (discharge current) so as to flow in the direction from the ignition plug 19 toward the secondary winding 311*b* (i.e. current I2 in the figure becomes a negative value). To achieve this, the anode of the diode 318*a* is connected to the side of the high voltage side terminal of the secondary winding 311*b*. On the other hand, the ignition plug 19 is connected to the side of the low voltage side terminal (also referred to as ground side terminal) of the secondary winding 311*b*.

The first switching element 313 is an IGBT (Insulated Gate Bipolar Transistor) which is a MOS gate structure transistor. The first switching element 313 includes a first control terminal 313G, a first power side terminal 313C, and a first ground side terminal 313E. The first switching element 313 controls on and off of current flow between the first power side terminal 313C and the first ground side terminal 313E, based on a first control signal IGa inputted into the first control terminal 313G. In the present embodiment, the first power side 313C is connected to the side of the low voltage side terminal of the primary winding 311*a*. Additionally, the first ground side terminal 313E is connected to the ground side.

The second switching element 314 is a MOSFET (Metal Oxide Semiconductor Field Effect Transistor) including a second control terminal 314G, a second power side terminal 314D, and a second ground side terminal 314S. The second switching element 314 controls on and off of current flow between the second power side terminal 314D and the second ground side terminal 314S, based on a second control signal IGb inputted into the second control terminal 314G.

In the present embodiment, the second ground side terminal 314S is connected to the side of the low voltage side terminal of the primary winding 311*a* through the diode 318*b*. The diode 318*b* permits current to flow in the direction from the second ground-side terminal 314S of the second switching terminal 314 toward the primary winding 311*a*. To achieve this, the anode of the diode 318*b* is connected to the second ground side terminal 314S.

The third switching element 315 is an IGBT, which is a MOS gate structure transistor, and has a third control terminal 315G, a third power side terminal 315C, and a third ground side terminal 315E. The third switching element 315 controls on and off of current flow between the third power side terminal 315C and the third ground side terminal 315E, based on the third control signal IGc inputted into the third ground side terminal 315G.

In the present embodiment, the third power side terminal 315C is connected to the second power side terminal 314D of the second switching element 314 through the diode 318*c*. The diode 318*c* permits current to flow in the direction from the third power side terminal 315C of the third switching element 315 to the second power side terminal 314D of the second switching element 314. To achieve this, the anode of the diode 318*c* is connected to the third power side terminal 315C. In addition, the third ground side terminal 315E of the third switching element 315 is connected the ground side.

The energy accumulation coil 316 is an inductor provided so as to accumulate energy by on operation of the third switching element 315. The energy accumulation coil 316 is interposed in the power line, which connects between the above-described non-ground side output terminal of the DC power supply 312 and the third power side terminal 315C of the third switching terminal 315.

The capacitor 317 is connected to the energy accumulation coil 316 in series and between the ground side and the above-described non-ground side output terminal of the DC power supply 312. That is, the capacitor 317 is connected to the third switching element 315 in parallel with respect to the energy accumulation coil 316. The capacitor 317 accumulates energy by off operation the third switching element 315.

The driver circuit 319 configuring a controller is connected to the electronic control unit 32 so as to receive the engine parameters, the ignition signal IGt, and the energy input period signal IGw outputted from the electronic control unit 32. In addition, the driver circuit 319 is connected to the first control terminal 313G, the second control terminal 314G, and the third control terminal 315 G so as to control the first switching terminal 313, the second switching terminal 314, and the third switching terminal 315. The driver circuit 319 is provided so as to output the first control signal IGa, the second control signal IGb, and the third control signal IGc to the first control terminal 313G, the second control terminal 314G, and the third control terminal 315G, respectively, based on the received ignition signal IGt and the energy input period signal IGw.

Specifically, the driver circuit 319 discharges the accumulated energy (by on operation of the second switching terminal 314) from the capacitor 317 during ignition discharge of the ignition plug 19 (which is started by off operation of the first switching element 313). Thereby, the primary current is supplied from the side of the low voltage side terminal of the primary winding 311*a* to the primary winding 311*a*. To achieve this, each of the switching elements is controlled. In the present embodiment, particularly, the driver circuit 19 controls the second switching terminal 314 and the third switching terminal 315 to vary the accumulated amount or the discharged amount of the energy accumulated in the capacitor 317 depending on the engine parameter.

<Description of Operation of First Embodiment>

Hereinafter, operation (action and effects) according to the configuration of the first embodiment will be described. In time charts shown in FIG. 3 and FIG. 4, Vdc represents the voltage of the capacitor 317. I1 represents the primary current. 12 represents the secondary current. P represents energy (hereinafter, referred to as "input energy") which is discharged from the capacitor 317 and is supplied to the primary winding 311*a* from the side of the low voltage side terminal of the primary winding 311*a*.

Figure 3:
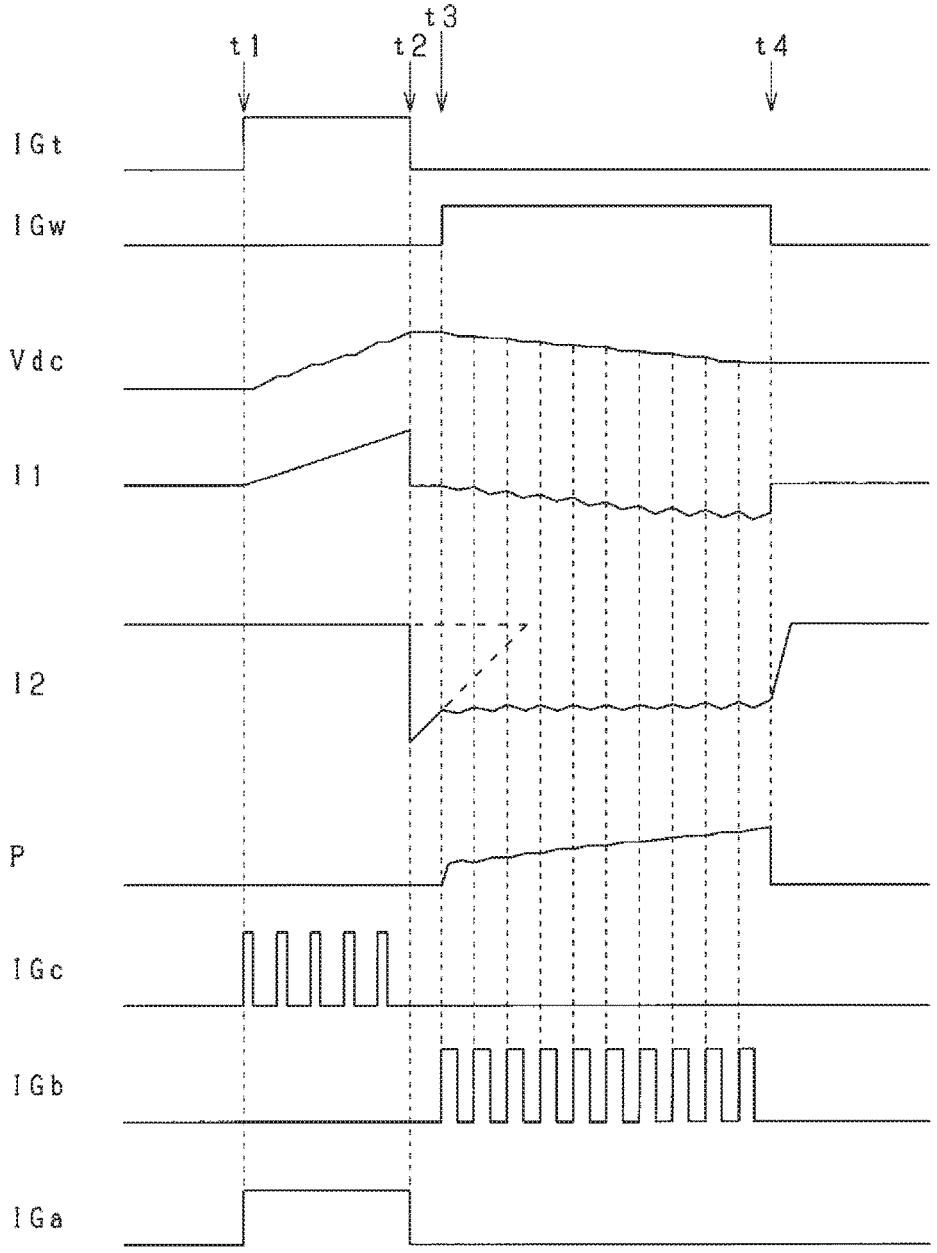
FIG. 3 is a time chart for explaining operation of the ignition control apparatus shown in FIG. 2.
Figure 4:
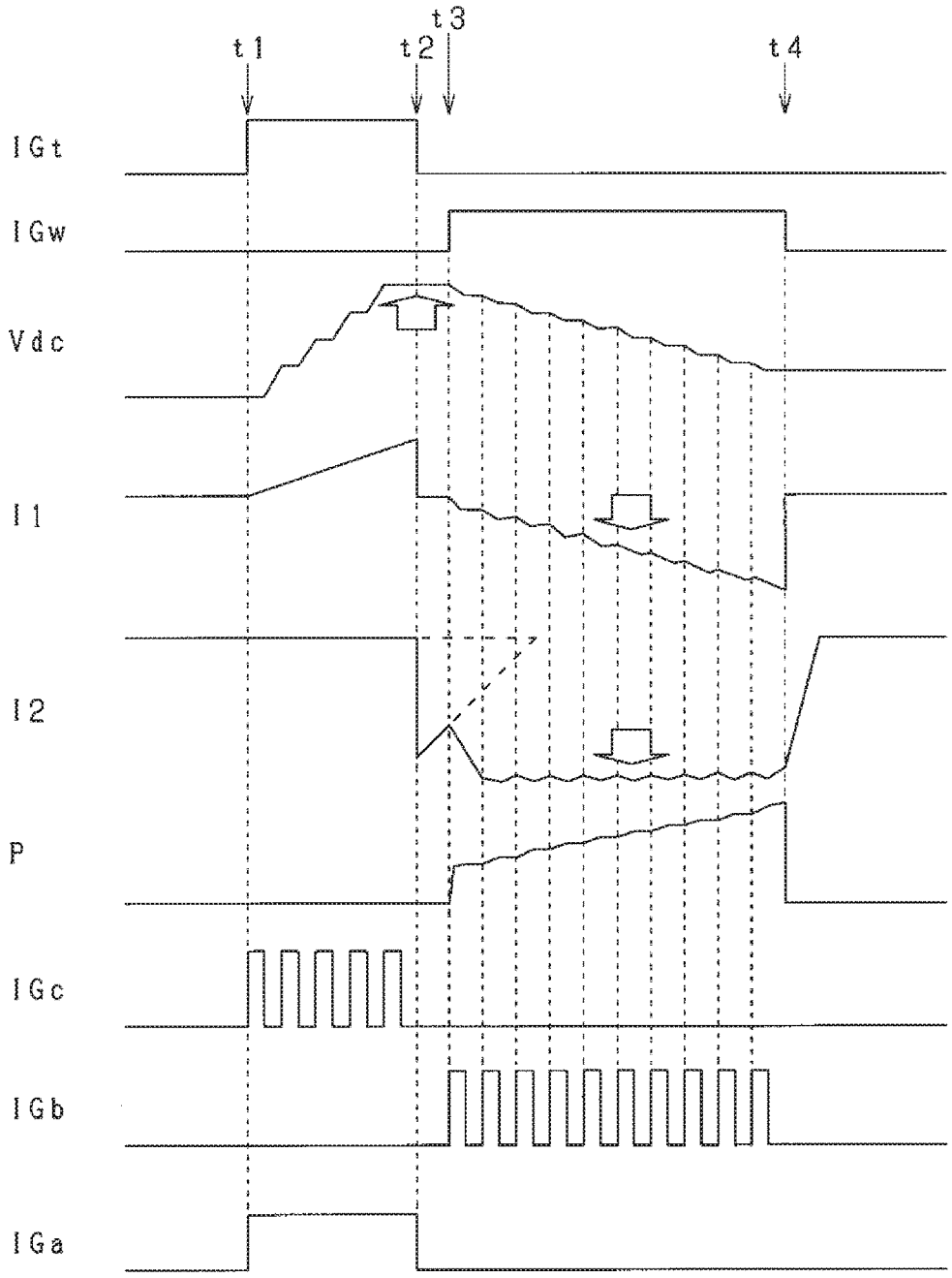
FIG. 4 is a time chart for explaining operation of the ignition control apparatus shown in FIG. 2.

Note that, in the time charts of the primary current I1 and the secondary current I2 in FIGS. 3 and 4, the direction indicated by arrows in FIG. 2 represents the positive value. In addition, the time chart of the input energy P shows an integrated value of the input energy obtained from the time when the supply is started (rise of the initial second control signal IGb) at one ignition timing. In addition, in the ignition signal IGt, the energy input period signal IGw, the first control signal IGa, the second control signal IGb, and the third control signal IGc, the state of rise upward is H, and the state of fall downward is L.

The electronic control unit 32 controls operation of each part of the engine system 10 according to the engine parameters acquired based on outputs of various sensors such as the rotation speed sensor 33. The part of the engine system 10 includes the injector 18 and the ignition circuit unit 31. The ignition control is described herein in detail. The electronic control unit 32 generates the ignition signal IGt and the energy input period signal IGw based on the acquired engine parameters. Thereafter, the electronic control unit 32 outputs the generated ignition signal IGt and energy input period signal IGw, and the engine parameters to the driver circuit 319.

The driver circuit 319 receives the ignition signal IGt, the energy input period signal IGw, and the engine parameter outputted from the electronic control unit 32. Based on these, the driver circuit 319 outputs the first control signal IGa for controlling on and off of the first switching element 313, the second control signal IGb for controlling on and off of the second switching element 314, and the third control signal IGc for controlling on and off of the third switching element 315.

Note that, in first embodiment, the first control signal IGa is the same as the ignition signal IGt. Hence, the driver circuit 319 outputs the received ignition signal IGt to the first control terminal 313G of the first switching element 313 without change.

Meanwhile, the second control signal IGb is generated based on the received energy input period signal IGw. Hence the driver circuit 319 generates the second control signal IGb based on the received energy output period signal IGw. Additionally, the driver circuit 319 outputs the second control signal IGb to the second control terminal 314G of the second switching element 314. Note that, in the present embodiment, the second control signal IGb is repeatedly outputted while the energy input period signal IGw is H level. That is, the second control signal IGb is a square-wave-pulsed signal having a constant period and on duty ratio (1:1).

In addition, the third control signal IGc is generated based on the received ignition signal IGt and engine parameters. Hence, the driver circuit 319 generates the third control signal IGc based on the received ignition signal IGt and engine parameters. Additionally, the driver circuit 319 outputs the third control signal IGc to the third control terminal 315G of the third switching element 315. Note that, in the present embodiment, the third control signal IGc is repeatedly outputted while the ignition signal IGt level is H level. That is, the third control signal IGc is a square-waved-pulse signal whose period is constant and whose on duty ratio varies based on the engine parameters.

Hereinafter, with reference to FIG. 3, at the time t1, if the ignition signal IGt rises to the H level, the first control signal IGa is raised to the H level. Thereby, the first switching element 313 is turned on (at this time, since the energy input period signal IGw is L level, the second switching element 314 is off). Hence, the flow of the primary current through the primary winding 311*a* is started.

In addition, while the ignition signal IGt is in a state of rising to H level, the third control signal IGc having a square-waved-pulse shape is inputted into the third control terminal 315G of the third switching element 315. As a result, the voltage Vdc is increased in a step-wise manner during an off time period (i.e. during the time period during which the third control signal IGc is L level) after the third switching element 315 is on of on and off.

Accordingly, between the time t1 and t2 during which the ignition signal IGt in a state of rising to the H level, the ignition coil is charged, and energy is accumulated in the capacitor 317 via the energy accumulation coil 316. The accumulation of energy is completed by the time t2.

Thereafter, at the time t2, due to the fall of the first control signal IGa from the H level to the L level, the first switching element 313 is turned off. Thereby, the primary current which has flowed to the primary winding 311*a* is suddenly shut off. Then, larger secondary voltage is generated at the secondary winding 311*b* of the ignition winding 311. As a result, ignition discharge is started in the ignition plug 19, whereby the secondary current flows.

After the ignition discharge is started at time t2, according to a conventional discharge control (alternatively, under the operation condition under which the energy input period signal IGw is not raised to H level and is maintained in L level), the discharge current approaches to zero with time, if nothing is done, as shown by a broken line, and decreases so that discharge cannot be maintained. Then, the discharge ends.

In this regard, in the present operation example, the energy input period signal IGw raises to the H level at time t3 immediately after the time t2. Thereby, the second switching element 314 is turned on (the second control signal IGb=H level) in a state where the third switching element 315 is off (the third control signal IGc=L level). Then, the accumulated energy of the capacitor 317 is discharged therefrom, and the input energy described above is supplied from the side of the low voltage side terminal of the primary winding 311*a* to the primary winding 311*a*. Hence, the primary current caused doe to the inputted energy flows during the ignition discharge.

In this time, an additional current accompanying the flow of the primary current caused due to the input energy is superimpose on the discharge current flowing between the time t2 and t3. The superimposition (addition) of the temporary current is performed every time when the second switching element 314 is turned on after the time t3 (until t4). That is, as shown in FIG. 3, every time when the second control signal IGb rises, the primary current (I1) is added in series by the accumulated energy of the capacitor 317. Accordingly, the discharge current (I2) is added in series. Hence, the discharge current is efficiently secured so as to maintain the ignition discharge. Note that, in the present specific example, the time interval between the time t2 and t3 is appropriately set (by using a map or the like) by the electronic control unit 32, based on engine rotation speed Ne and the intake air mass Ga, so as to prevent the so-called blow off.

Incidentally, the energy accumulation state of the capacitor 317 between the time t1 and t2, during which the ignition signal IGt is in a state of rising to the H level, can be controlled by an on duty ratio of the third control signal IGc. In addition, the larger the accumulated energy in the capacitor 317, the larger the input energy caused every time when the second switching element 314 is turned on.

Herein, according to the present embodiment, the higher the load and the rotation operation conditions (intake pressure Pa: high, engine rotation speed Ne: high, throttle opening THA: large, EGR rate: high, air fuel ration: lean) under which the so-called blow off is easily caused, the higher the on duty ratio of the third control signal IGc is set. Hence, as shown in FIG. 4, in accordance with the engine operation state (specifically, refer to arrows shown in FIG. 4), the energy accumulation mass and the input energy of the capacitor 317 can be increased, while suppressing the power consumption and desirably restricting the blow off.

As described above, according to the configuration of the present embodiment, to prevent the so-called blow off, the flow state of the discharge current can be desirably controlled in response to the flow state of the gas in the cylinder 11*b*. Therefore, according to the present embodiment, the occurrence of the so-called blow off and the accompanying ignition energy loss can be desirably suppressed by a simplified configuration of the apparatus.

That is, as shown in the configuration in the present embodiment, by inputting energy from the side of the low voltage terminal (the side of the first switching element 313) of the primary winding 311*a*, energy can be inputted at lower voltage, compared with the energy inputted from the side of the secondary winding 311*b*. In this regard, if energy is inputted from the high voltage side terminal of the primary winding 311*a* at a voltage higher than that of the DC power supply 312, the efficiency becomes lower due to the current flowing into the DC power supply 312 or the like. In contrast, according to the configuration of the present embodiment, as described above, since energy is inputted from the side of the low voltage terminal of the primary winding 311*a*, an excellent advantage can be provided that energy can be inputted most easily and efficiently.

<Configuration of Ignition Control Apparatus in Second Embodiment>

Hereinafter, the configuration of the ignition circuit unit 31 of the second embodiment is described. Note that, in the description of the second embodiment, similar reference numerals to those of the first embodiment may be used for the parts having similar configuration and function to those of the above first embodiment. In addition, regarding descriptions of the parts, the descriptions of the first embodiment may be appropriately adopted within the scope in which technical contradictions do not arise.

Figure 5:
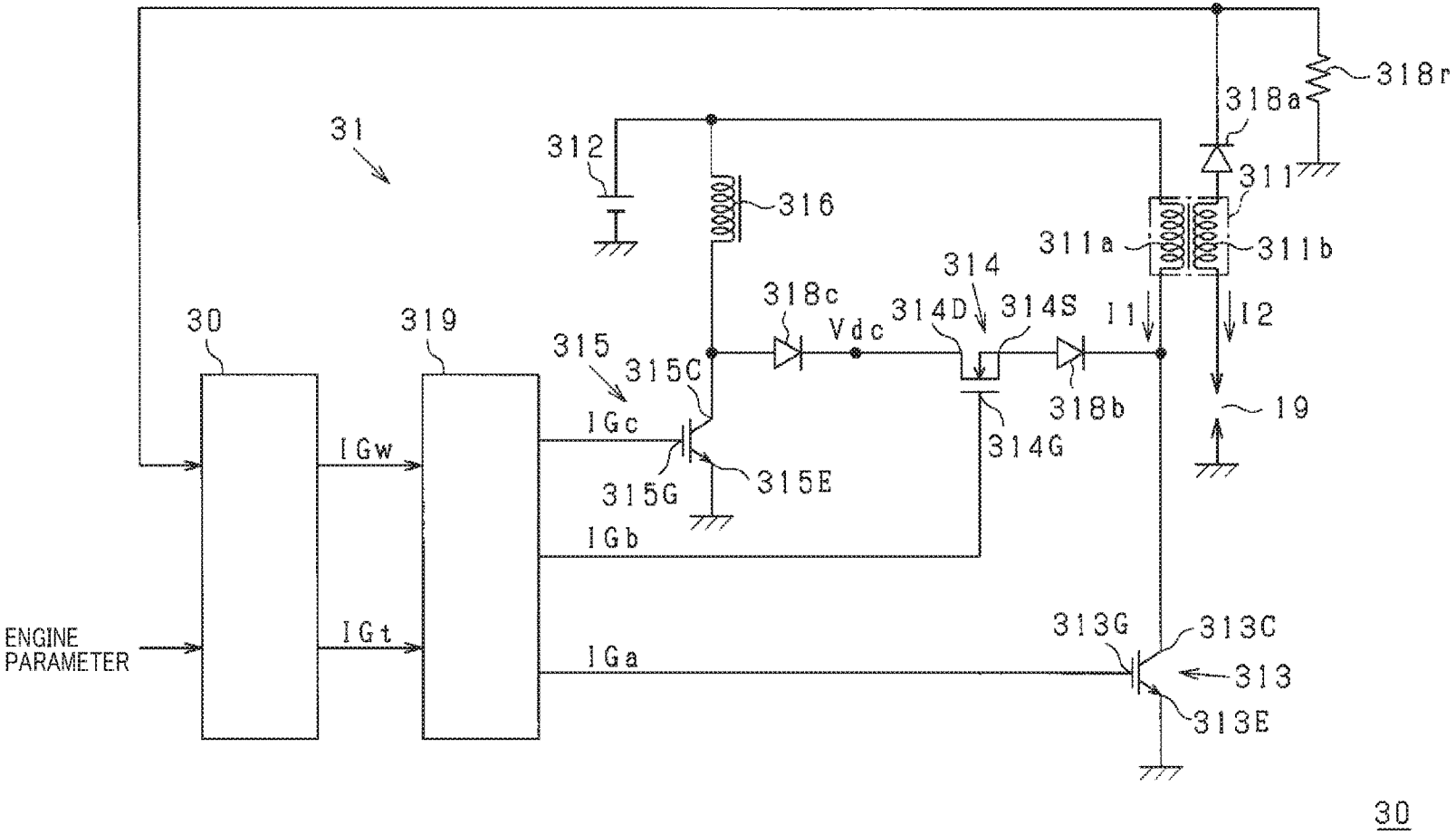
FIG. 5 is a schematic circuit diagram according to a second embodiment of the ignition control apparatus shown in FIG. 1.

As shown in FIG. 5, in the ignition circuit unit 31 of the present embodiment, the non-ground side terminal (terminal which is opposite to the side on which the ignition plug 19 is connected) of the secondary winding 311*b* is connected to the ground side through the diode 318*a* and a discharge current detection resistor 318*r*. The diode 318*a* regulates the secondary current (discharge current) so as to flow in the direction from the ignition plug 19 toward the secondary winding 311*b* (i.e. current I2 in the figure becomes a negative value). To achieve this, the anode thereof is connected to the side of the non-ground side terminal of the secondary winding 311*b*. The discharge current detector resistor 318*r* is provided so as to generate a voltage corresponding to the secondary current (discharge current) at the connection point with the cathode of the diode 318*a*. The connecting position is connected to the ignition control apparatus 30 so as to input the voltage at the position to the ignition control apparatus 30.

In the present embodiment, the third power side terminal 315 C is connected to the second power side terminal 314D of the second switching element 314 via the diode 318*c*. The anode of the diode 318*c* is connected to the third power side terminal 315C so as to permit the current flow in the direction from the third power side terminal 315C of the third switching element 315 to the second power side terminal 314D of the second switching element 314.

<Description of Operation of Second Embodiment>

Hereinafter, operation (action and effects) according to the configuration of the second embodiment will be described. In the time chart shown in FIG. 6, Vdc represents the voltage of the second power side terminal 314D of the second switching element 314.

Herein, in the present embodiment, the third control signal IGc rises to the H level at the same time when the energy input period signal IGw rises to the H level. The third control signal IGc repeatedly rises at predetermined intervals while the energy input period signal IGw is H level. The third control signal IGc is a square-wave-pulsed signal having a constant on duty ratio (1:1). In addition, the second control signal IGb repeatedly rises in such a manner in which the second control signal IGb and the energy input period signal IGw alternatively rise while the energy input period signal IGw is H level. The second control signal IGb is a square-wave-pulsed signal having a constant on duty ratio (1:1).

Figure 6:
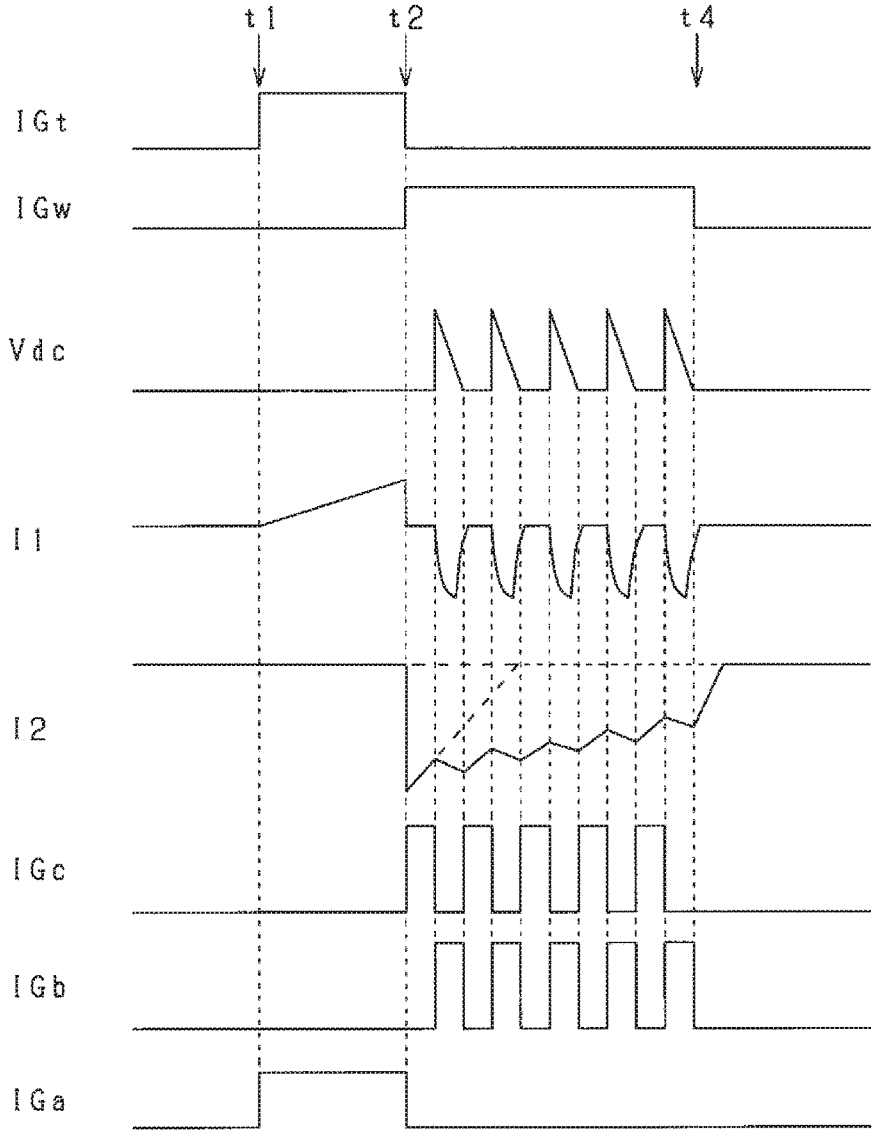
FIG. 6 is a time chart for explaining operation of the ignition control apparatus shown in FIG. 5.

That is, as shown in FIG. 6, the second control signal IGb rises from the L level to the H level at the same time when the third control signal IGc falls from the H level to the L level. In addition, the third control signal IGc rises from the L level to the H level at the same time when the second control signal IGb falls from the H level to the L level.

Hereinafter, with reference to FIG. 6, the first control signal IGa is raised to the H level in response to the rise of the ignition signal IGt to the H level at the time t1. Hence, the first switching element 313 is turned on (at this time, since the energy input period signal IGw is L level, the second switching element 314 and the third switching element 315 are off). Accordingly, the flow of the primary current in the primary winding 311*a* starts.

Accordingly, between the time t1 and t2 during which the ignition signal IGt is in a state of rising to the H level, the ignition coil 311 is charged. Thereafter, when the first control signal IGa falls from the H level to the L level at time t2 at the time t2 to turn off the first switching element 313, the primary current which has flowed into the primary winding 311*a* is suddenly shut off. Then, a high voltage is generated in the primary winding 311*a* of the ignition coil 311, and the high voltage is further increased in the secondary winding 311*b*. Thereby, a high voltage is generated in the ignition plug 19 to generate discharge. In this time, a discharge current is generated, which is a larger secondary current, in the secondary winding 311*b*. Hence, ignition discharge is started in the ignition plug 19.

Herein, after the ignition discharge is started at time t2, according to a conventional discharge control (alternatively, under the operation condition under which the energy input period signal IGw is not raised to H level and is maintained in L level), the discharge current approaches to zero with time, if anything is done, as shown by a broken line, and decreases so that discharge cannot be maintained. Then, the discharge ends.

In this regard, in the present embodiment, at the time t2, the energy input period signal IGw is raised from the L level to the H level at the same time when the ignition signal IGt falls from the H level to the L level. Then, first, the third control signal IGc is raised to the H level while the second control signal IGb is maintained in the L level. That is, the third switching element 315 is turned on in a state where the second switching element 314 is off. As a result, energy is accumulated in the energy accumulation coil 316.

Thereafter, the second control signal IGb is raised to the H level at the same time when the third control signal IGc falls from the H level to the L level. At this time, the second switching element 314 is turned on at the same time when the DC/DC converter including the energy accumulation coil 316 is increased by turning off of the third switching element 315. Then, the energy discharged from the energy accumulation coil 316 is supplied from the side of the low voltage side terminal of the ignition coil 311 to the ignition coil 311. As a result, during the ignition discharge, a primary current due to the input energy flows.

Accordingly, when the primary current is supplied from the energy accumulation coil 316 to the primary winding 311*a*, an additional current accompanying the supply of the primary current is superimposed on the discharge current which has flowed. Hence, the discharge current can be efficiently secured so that the ignition discharge can be maintained. The accumulation of the energy in the energy accumulation coil 316 and the superimposition of the discharge current due to the supply of the primary current from the energy accumulation coil 316 described above are repeatedly performed by the alternate outputs of the on pulse of the third control signal IGc and the on pulse of the second control signal IGb until the time t4 at which the energy input period signal IGw falls from the H level to the L level.

That is, as shown in FIG. 6, energy is accumulated in the energy accumulation coil 316 every time when a pulse of the third control pulse IGc rises. Then, primary current (I1) is sequentially added by the input energy supplied from the energy accumulation coil 316 every time when a pulse of the second control signal IGb rises. In response to this, discharge current (I2) is sequentially added.

As described above, according to the configuration of the present embodiment, to prevent the so-called blow off, the discharge current can be desirably maintained. In addition, even in the configuration of the present embodiment, energy is inputted from the side of the low voltage terminal (side of the first switching element 313) of the primary winding 311*a* to achieve efficient energy input at lower voltage as in the case of the above first embodiment. Additionally, in the configuration of the present embodiment, the capacitor in the conventional configuration disclosed in the Japanese Patent Laid-open publication no. 2007-231927 is omitted. Hence, according to the present embodiment, the generation of the so-called blow off and the resulting loss are desirably suppressed by the apparatus configuration simpler than that of the conventional one.

<Modifications>

Hereinafter, typical modifications are exemplified. In the description of the following modifications, similar reference numerals to those of the above embodiments may be used for the parts having similar configuration and function to those of the above embodiments. In addition, regarding descriptions of the parts, the descriptions of the above embodiments may be appropriately adopted within the scope in which technical contradictions do not arise. Needless to say, modifications are not limited to the following. In addition, part of the above embodiments and the whole or part of the plurality of modifications may be appropriately applied compositely within the scope in which technical contradictions do not arise.

The present invention is not limited to the specific configurations exemplified in each of the embodiments described above. That is, part of the functional blocks of the electric control unit 32 may be integrated with driver circuit 319. Alternatively, the driver circuit 319 may be divided for each switching element. In this case, when the first control signal IGa is the ignition signal IGt, the ignition signal IGt may be outputted from the electric control unit 32 directly to the first control terminal 313G of the first switching element 313 not through the diver circuit 319.

The present invention is not limited to the specific operation shown in each of the embodiments described above. That is, for example, in the above first embodiment, an optional engine parameter can be used as the control parameter, the optional engine parameter being selected from the intake pressure Pa, the engine rotation speed Ne, the throttle opening THA, the EGR rate, the air/fuel ratio, the amount of intake air Ga, the accelerator operation amount ACP and the like. Additionally, instead of the engine parameter, other information usable for generating the second control signal IGb and the third control signal IGc may be outputted from the electronic control unit 32 to the driver circuit 319.

Instead of the duty control of the third control signal IGc exemplified in the above first embodiment, or in addition to this, the input energy may be varied by the control of the waveform of the energy input period signal IGw (rising timing at t3 and/or the time period between t3 and t4 in FIG. 3 or the like). In this case, instead of the drive circuit 319, or in addition to this, the electronic control unit 32 corresponds to a controller.

In the first embodiment described above, the third control signal IGc may be a waveform in which the the wave rises once and falls once while the first control signal IGa is H level.

In the second embodiment described above, the primary current supply (the third switching element 315 is off and the second switching element 314 is on) from the energy accumulation coil 316 may be performed at the time when the discharge current detected by the discharge current detector resistor 318*r* becomes equal to lower than a predetermined value.

Figure 7:
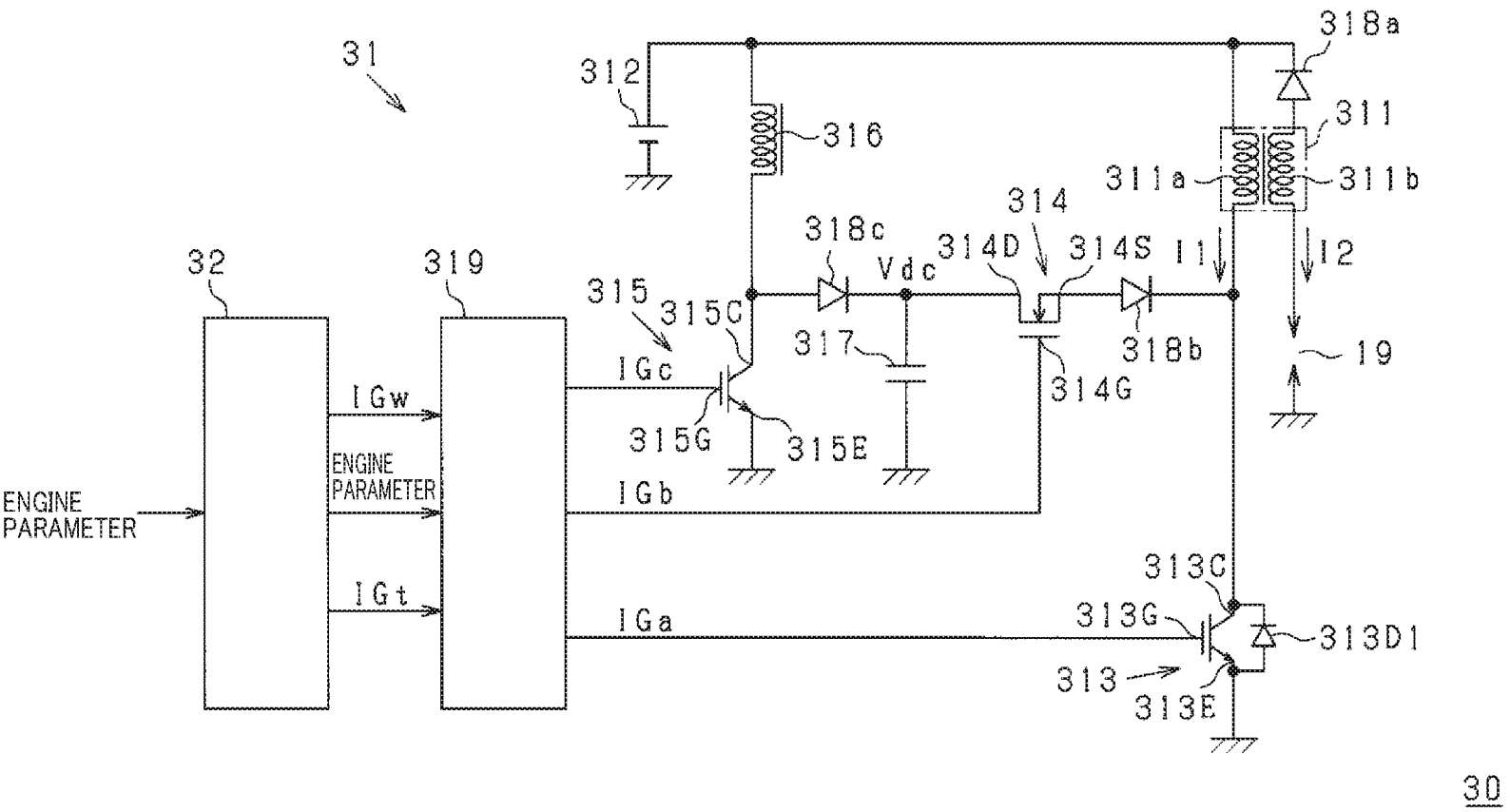

In the each of the embodiments described above, the first switching element 313 is not limited to the IGBT (this is applied to other embodiments described below). That is, the first switching element 313 may be a so-called power MOSFET. If the first switching element 313 is an IGBT, a built-in diode type, which is conventionally and widely used, may be suitably applied (refer to FIG. 7). That is, the reflux diode 313D1 shown in FIG. 7 is installed in the first switching element 313. The cathode of the reflux diode 313D1 is connected to the first power side terminal 313C, and the anode of the reflux diode 313D1 is connected to the first ground side terminal 313E.

Figure 8:
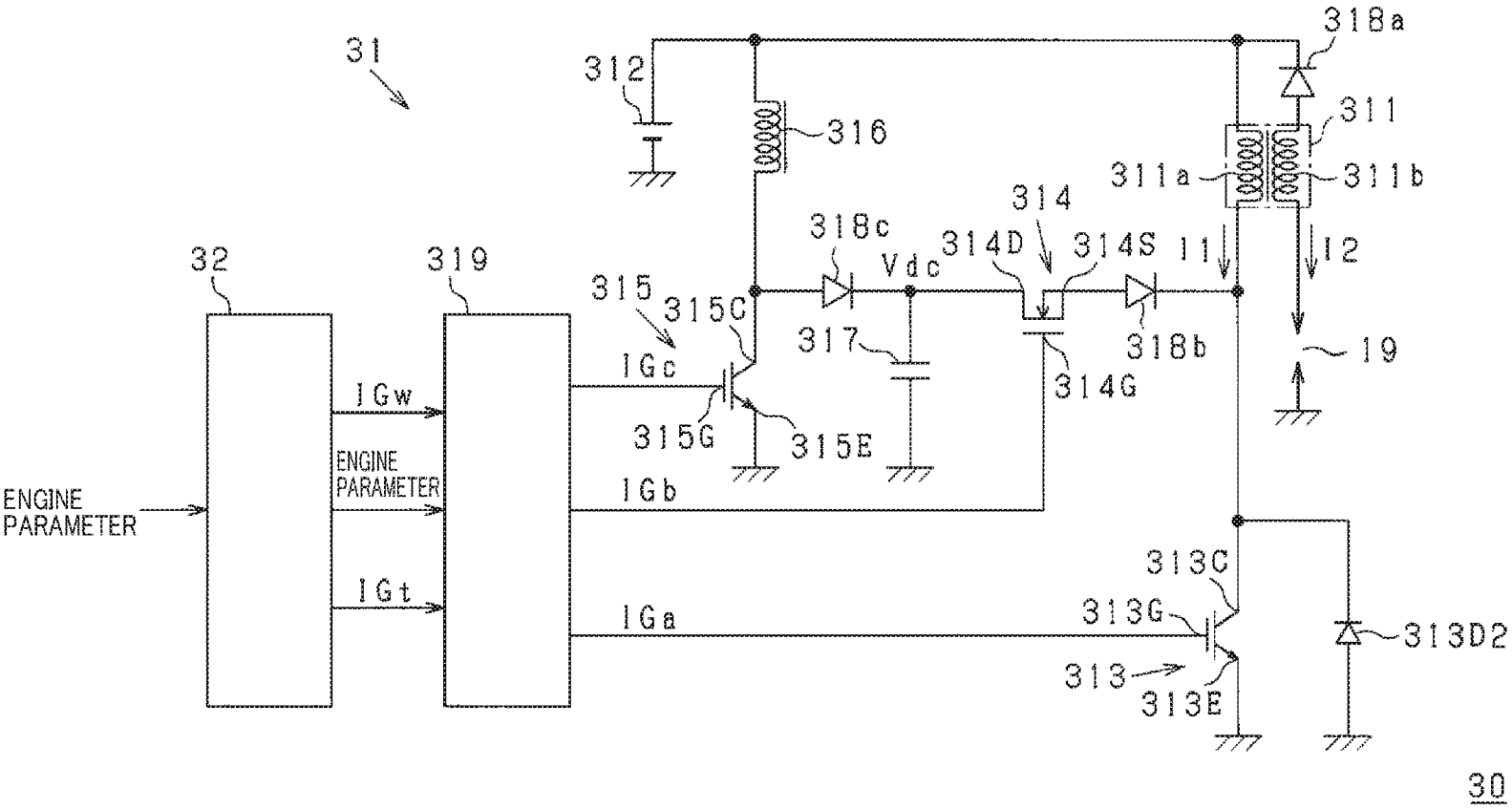

Note, the reflux diode 313D1 can be substituted by an external reflux diode 313D2, as shown in FIG. 8. In this case the reflux 313D2 the cathode is connected to the first power-side terminal 313C, and the anode connected to the first-ground-side terminal 313E.

According to reflux diodes 313D1 and 313D2, especially in an operation state in which the gas speed in the cylinder is significantly higher, and the possibility of generating a blow off is extremely high, the circulation path of the primary current due to on/off of the input energy, especially the circulation path due to off of the input energy, is desirably formed. Thereby, the secondary current can be controlled to a predetermined value. In addition, in the configuration shown in FIG. 7, since the reflux diode 313DI with a higher withstand voltage is installed in the first switching element 313, the circuit configuration is simplified.

When using the N channel-type power MOSFET as the first switching element 313, a parasitic diode can be used as the above reflux diode (refer to the reflux diode 313D shown in FIG. 7). In this case, the withstand voltage of the reflux diode formed from the parasitic diode is the same as the withstand voltage of the first switching element 313. Hence, according to this configuration, the reflux diode with higher withstand voltage and the switching element can be integrated (one chip).

Note, even when the IGBT is used as the first switching element 313, the circuit configuration shown in FIG. 7 can be realized by connecting an equipotential ring and a lead frame by wire bonding or the like. The equipotential ring formed in a withstand pressure structure provided at the outer peripheral of the IGBT chip (The equipotential ring is a conductive film pattern formed on a channel stopper region which is an n+ region, that is, a highly concentrated n type diffusion region. The configuration is known. For example, refer to the Japanese Patent Laid-open publication No. 7-249765.) The lead frame is connected to the first power side terminal 313C (collector). In this case, the PN joint from the emitter to the collector is used as a built-in diode (virtual parasitic diode). According to the configuration also, the circulation diode with higher withstand voltage and the switching element can be integrated (one chip).

<Ignition Control Apparatus of Third Embodiment>

Hereinafter, the configuration, action, and effects of the ignition circuit unit 31 of another embodiment are described. Note that, in each embodiment described later, an IGBT having a built-in type reflux diode 313D is used as the first switching element 313. In addition, as in the cases of the above embodiments, an N channel MOFFSET is used as the second switching element 314. Furthermore, a power MOFFSET (more specifically, N channel MOFFSET) having a third control terminal 315G, a third power side terminal 315D, and a third ground side terminal 315 S are used as the third switching element 315.

Figure 9:
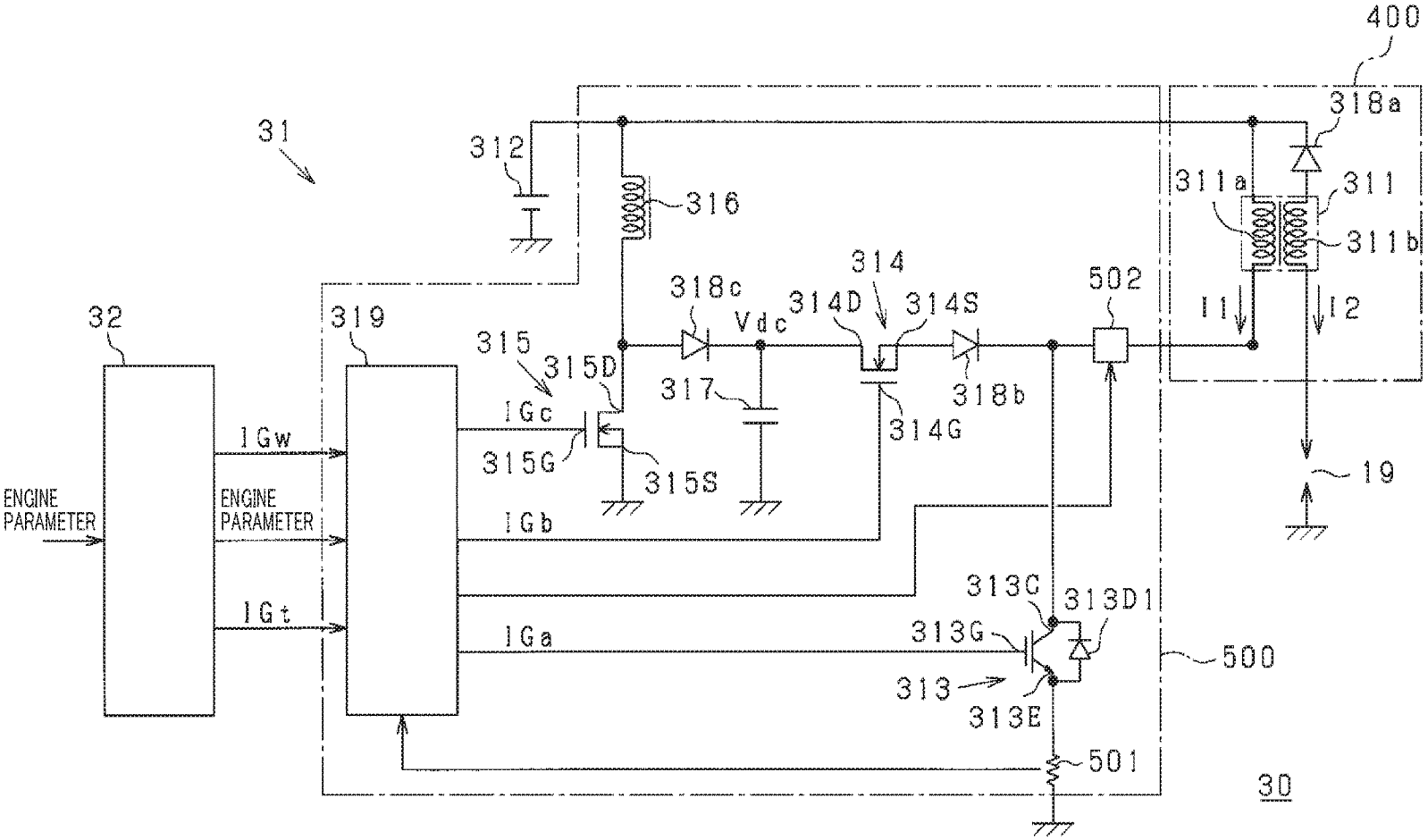
FIG. 9 is a schematic circuit diagram according to a third embodiment of the ignition control apparatus shown in FIG. 1.

In the third embodiment shown in FIG. 9, the ignition circuit unit 31 includes a coil unit 400 and a driver unit 500.

The coil unit 400 is a unit including an ignition coil 311 and a diode 318, and is connected to a driver unit 500 and an ignition plug 19 via a predetermined removable connector. That is, the coil unit 400 is configured such that, if the ignition coil 311 or the diode 318*a* is broken, the broken one can be replaced.

The driver unit 500 is a unit of the main part (each of the switching elements, the energy accumulation coil 316, the capacitor 317, and the like) of the ignition circuit 31, and is connected to the DC power supply 312 and the coil unit 400 via a predetermined removable connector. That is, the driver unit 500 is configured such that, if at least one of the energy accumulation coil 316, the capacitor 317, each of the switching elements, and the like is broken, the broken one can be replaced.

In addition, in the present embodiment, the driver unit 500 is provided with a primary current detection resistor 501 and a shut off switch 502. The primary current detection resistor 501 is interposed between the first ground side terminal 313E of the first switching element 313 and the ground side. The shut off switch 502 is interposed in a current path between the primary winding 311*a* and the first switching element 313 so that the shut off switch 502 can shut off the current path depending on the primary current detected by the first current detection resistor 501. The control input terminal (the terminal to which a signal is inputted to switch between a communication state and a shut off state of the above current route) of the shut off switch 502 is connected to the driver circuit 319.

Specifically, the shut off switch 502 is provided between the connection point between the cathode of the diode 318*b* and the first power side terminal 313C of the switching element 313, and the primary winding 311*a*. The shut off switch 502 in the present embodiment is a transistor. The emitter of the transistor is connected to the primary winding 311*a*. In addition the collector of the transistor is connected to the connection point between the cathode of the diode 318*b* and first power side terminal 313C of the first switching element 313.

In the configuration, the driver circuit 319 detects presence or absence of occurrence of failure in the first switching element 313, based on the primary current detected by using the primary current detection resistor 501. If the failure is detected, the driver circuit 319 shuts off the current path from the primary winding 311*a* to the first switching element 313, by turning off the shutoff switch 502. Thereby, when the above failure (particularly, a short circuit failure of the first switching element 313) occurs, carelessly braking the coil unit 400 can be reliably prevented.

In addition, in the configuration, when the failure occurs, the failure of the ignition circuit unit 31 can be overcome only by continually using the coil unit 400 and replacing the broken driver unit 500. Hence, according to the configuration, the cost of replacing parts can be desirably decreased.

Note that, in the third embodiment described hereinabove, the shut off switch 502 is not limited to a transistor (including a power MOSFET). Specifically, for example, the shut off switch 402 may be a relay.

<Configuration of Ignition Control Apparatus in Fourth Embodiment>

Figure 10:
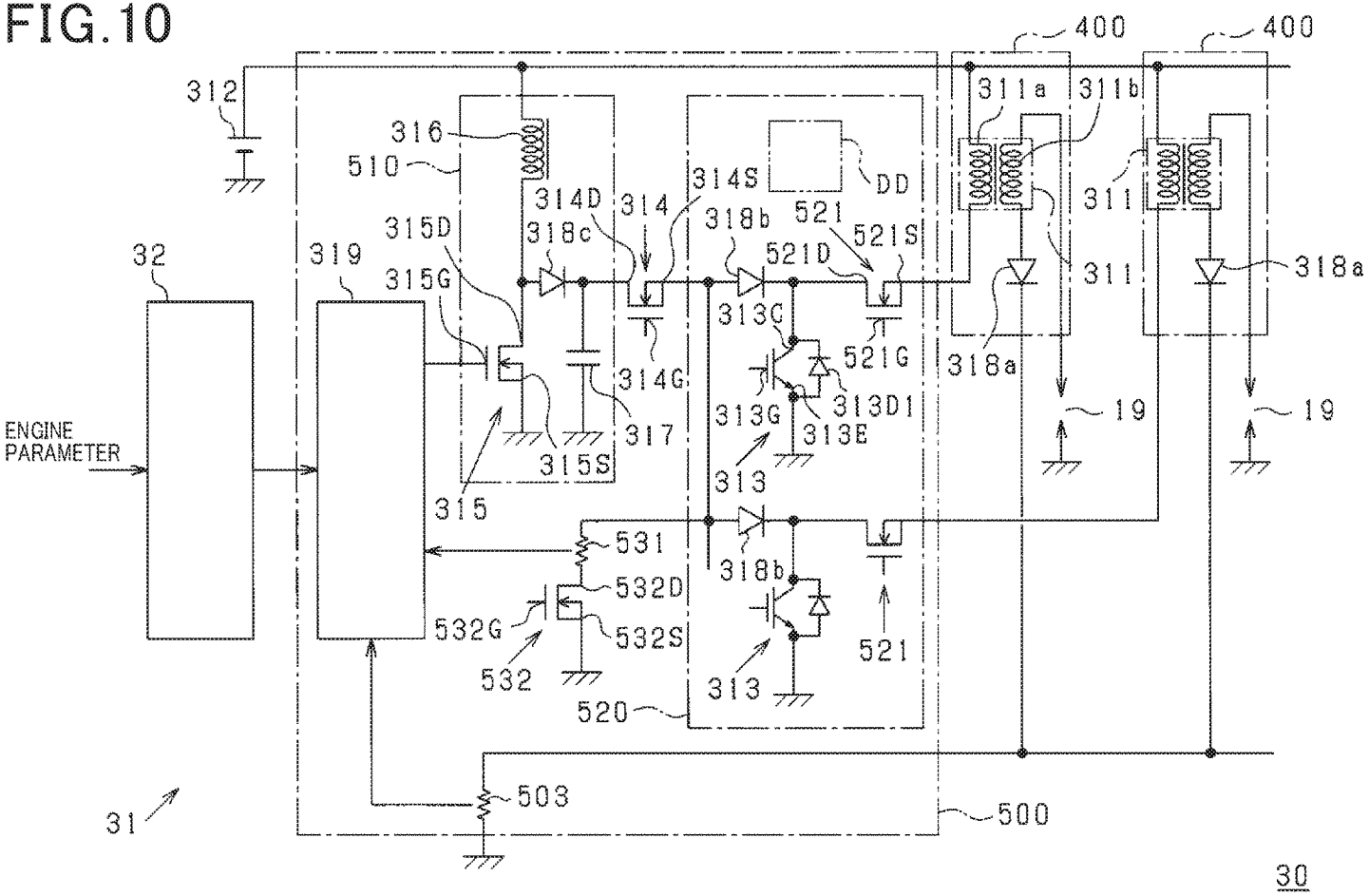
FIG. 10 is a schematic circuit diagram according to a four embodiment of the ignition control apparatus shown in FIG. 1.

Hereinafter, the configuration of the ignition circuit unit 31 of the fourth embodiment is described with reference to FIG. 10. In the present embodiment, the ignition circuit unit 31 includes a coil unit 400 and a driver unit 500. Specifically, as shown in FIG. 10, the present embodiment has a configuration in which a plurality of groups including the ignition plug 19 and the coil unit 400 are connected to the DC power supply 312 in parallel.

In the present embodiment, the driver unit 500 is provided with a secondary current detection resistor 503. One end side of the secondary current detection resistor 503 is connected to the side of the high voltage side terminal (also referred to as non-ground side terminal) of the secondary winding 311*b* of the corresponding group, via the diode 318*a* of each of the groups. That is, a plurality of diodes 318*a* are connected in parallel with one (common) secondary current detection resistor 503. Meanwhile, the other end side of the secondary current detection resistor 503 is grounded (connected to the ground side). In addition, in each of the groups, the side of the low voltage side terminal (also referred to as ground side terminal) of the secondary winding 311*b* is connected to the ignition plug 19 of the corresponding group.

In the present embodiment, the driver unit 500 includes a converter unit 510 and a distribution unit 520. The converter unit 510 is a unit including a third switching element 315, an energy accumulation coil 316, a capacitor 317, and a diode 318*c*. The converter unit 510 is connected to the DC power supply 312, the second switching element 314, and the driver circuit 319 by being attached to a main board of the driver unit 500 via a predetermined removable connecter.

In the distribution unit 520, a plurality of groups (the number of which are the same as that of the above groups including the ignition coil 19 and the coil unit 400) including a diode 318*b*, a first switching element 313, and a fourth switching element 521 are provided. The anode of the diode 318*b* of each of the groups is connected to the second ground side terminal 314S of the second switching element 314. That is a plurality of diodes 318*b* are connected to the second ground side terminal 314S of the second switching element 314 in parallel.

The fourth switching element 521 is interposed in a conduction path between the primary winding 311*a* and the second ground side terminal 314S of the second switching element 314. Specifically, in the example shown in FIG. 10, the fourth switching element 521 is provided between the primary foil 311*a* and the connection point between the cathode of the diode 318*b* and the first power side terminal 313C of the first switching element 313.

In the example shown in FIG. 10, the fourth switching element 521 is a MOSFET (more specifically, N channel MOSFET) and has a fourth control terminal 521G, a fourth power side terminal 521D, and a fourth ground side terminal 521S. In each of the groups, the fourth power side terminal 521D is connected to the connection point between the cathode of the diode 318*b* and the first power side terminal 313C of the first switching element 313. In addition, the fourth ground side terminal 521S is connected to the low voltage side terminal (ground side terminal) of the primary winding 311*a*. In addition, the fourth control terminal 521G is connected to the driver circuit 319.

Accordingly, in the present embodiment, a plurality of groups including the diode 318*b*, the first switching element 313, the fourth switching element 521, and the ignition coil 311 (primary winding 311*a*) are connected to one (common) second switching element 314 in parallel. In addition, the distribution unit 520 is configured so that the distribution unit 520 can be mounted on the main board of the driver unit 500 via the predetermined removable connector.

In addition an additional resistor 531 and an additional switch 532 are provided in the distribution unit 520. The additional resistor 531 and the additional switch 532 are interposed between the connection point between the second ground side terminal 314S of the second switching element 314 and the anode of the diode 318*b* of each of the groups, and the ground side. The additional resistor 531 serving as a resistor for failure detection is a resistor for current detection, and is provided between the connection point and the additional switch 532. The additional switch 532 is provided so that the additional switch 532 can shut out the current path between the connection point and ground side. That is, a plurality of diodes 318*b* are connected to common (one group of) additional resistor 531 and additional switch 532 in parallel.

In the example shown in FIG. 10, the additional switch 532 is a MOSFET (more specifically, N channel MOSFET) and has a control terminal 532G, a current side terminal 532D, and a ground side terminal 532S. The control terminal 532G is connected to the driver circuit 319. The power side terminal 532D is connected to the additional resistor 531. The ground side terminal 532S is grounded (connected to the ground side).

<Operation of Ignition Control Apparatus in Fourth Embodiment>

In the configuration of the present embodiment described above, the electronic control unit 32 generates each ignition signal IGt corresponding to each cylinder, based on acquired engine parameters. In addition, the electronic control unit 32 generates each energy input period signal IGw corresponding to each cylinder, based on the acquired engine parameters. Then, the electronic control unit 32 outputs various signals including the generated ignition signal IGt, the energy input period signal IGw, and the engine parameters to the driver circuit 319.

The driver circuit 319 controls on and off of the first switching element 313, the second switching element 314, the third switching element 315, the fourth switching element 521, and the additional switch 532 based on the various signals received from the electronic control unit 32 and the secondary current detected by using the secondary current detection resistor 503. Thereby, the ignition discharge control of the ignition plug 19 corresponding to each cylinder is performed while a secondary current is feedback-controlled. Note that, in the following detailed explanation of operation, a case is explained where ignition discharge is generated in only the left most ignition plug 19 included in the plurality of ignition plugs 19 shown in FIG. 10 to simplify the explanation.

The driver circuit 319 inputs an on pulse as indicated by IGa in FIG. 3 to the upper most first switching element 313 shown in FIG. 10 based on the ignition signal IGt corresponding to each cylinder which is received from the electronic control unit 32. Thereby, the ignition discharge in the corresponding ignition plug 19 starts in synchronization with the off timing of the first control signal IGa (ignition signal IGt). In addition, the driver circuit 319 inputs an on pulse as indicated by IGc in FIG. 3 to the third switching element 315 under an off state of the second switching element 314 in synchronization with the on pulse. As a result, the input energy is accumulated in the converter unit 510 (refer to the above first embodiment).

In the circuit configuration shown in FIG. 10, the fourth switching element 521 is interposed between the primary winding 311*a* of the ignition coil 311 and the first switching element 313. Hence, it is required that the fourth switching element 521, shown at the upper most part in FIG. 10, is turned on, while the primary current flows through the primary winding 311*a* of the ignition coil 311 shown at the left most part in FIG. 10. Hence, the fourth switching element 521 is turned on in synchronization with the on timing of the first control signal IGa (at the timing simultaneous with or slightly earlier than the on timing of the first control signal IGa). Additionally, the fourth switching element 521 is turned off in synchronization with the off timing of the energy input period signal IGw (at the timing simultaneous with or slightly later than the off timing of the energy input period signal IGw).

After the ignition discharge starts, as described above, the second switching element 314 is controlled by PWM control under off states of the first switching element 313 and the third switching element 315. Specifically, on duty of the second switching element 314 is feedback-controlled, based on the secondary current detected by the secondary current detection resistor 503. Hence, the input energy for preventing the blow off is inputted into the primary winding 311*a* of the ignition coil 311 shown at the left most in FIG. 10 from the converter unit 510 side.

Incidentally, the switching operation of the second switching element 314, which is an N channel MOSFET, is performed by, for example, a boot strap circuit provided at the driver circuit 319 side. In this regard, in the circuit configuration shown is FIG. 10, it is assumed that the connection point between the anode of the diode 318*b* and the second ground side terminal 314S of the second switching element 314 is in a float state (that is, a case where there is no current path connecting between the connection point and the ground side via the additional resistor 531 and additional switch 532). In this case, in a state where both the second switching element 314 and the fourth switching element 521 are in off states, the electric potential of the second ground side terminal 314S of the second switching element 314 becomes unstable. As a result, a concern is caused that the switching operation of the second switching element 314 cannot be performed (because charging the boot strap capacitor of the boot strap circuit described above cannot be performed).

Herein, in the present embodiment, as shown in FIG. 10, a conduction path having a switch (specifically, additional switch 532) is provided to fall the electric potential of the second ground side terminal 314S to the ground level before the switching operation of the second switching element 314S. Hence, in the present embodiment, by continuously turning on the additional switch 532 during a time period during which the first control signal IGa is on, the electric potential of second ground side terminal 314S is desirably set to the ground level before the switching operation of the second switching element 314. After this state is established, the additional switch 532 is turned off. Then, the PMW control of the second switching element 314 starts in accordance with the rising of the energy input period signal IGw. As a result, the switching operation of the second switching element 314 is performed desirably.

In addition, if a short circuit failure of the second switching element 314 occurs, the detection value of the voltage across the additional resistor 531 (i.e. the electric potential of the end of the side of the connection point described above of the additional resistor 531) becomes higher than 0 V (GND). In this regard, in the configuration of the present embodiment, the driver circuit 319 monitors the voltage across the additional resistor 531 during the time period during which the additional switch 532 is in an on state (during the time period, the second switching element 314 is in an off state as described above) and the time period during which the energy input period signal IGw is in an off state. As a result, the occurrence of short circuit failure of the second switching element 314 can be detected without providing a current detection resistor or the like in the input path of the input energy.

In addition, in the configuration of the present embodiment, the fourth switching elements 521 for cylinder distribution, which are switched at a comparatively low speed (low frequency), are individually provided for the plurality of ignition coils 311. In contrast, the second switching element 314, which is switched at a comparatively high speed (high frequency), is common to the plurality of ignition coils 311. Specifically, the configuration differs from the configuration in which the second switching elements 314 are individually provided for the plurality of ignition coils 311, in that circuits for controlling the drive of the second switching elements 314 are integrated (in the above example, such a circuit is provided in the driver circuit 319). Hence, according to the configuration, the circuit configuration of the ignition circuit unit 31 can be simplified (miniaturized) as possible.

Note, the on-timing of the additional switch 532 is not particularly limited, as long as the second switching element 314 is in an off state, and the electric potential of the second ground side terminal 314S is desirably set to the ground-level at the on-timing of the second switching element 314.

Figure 11:
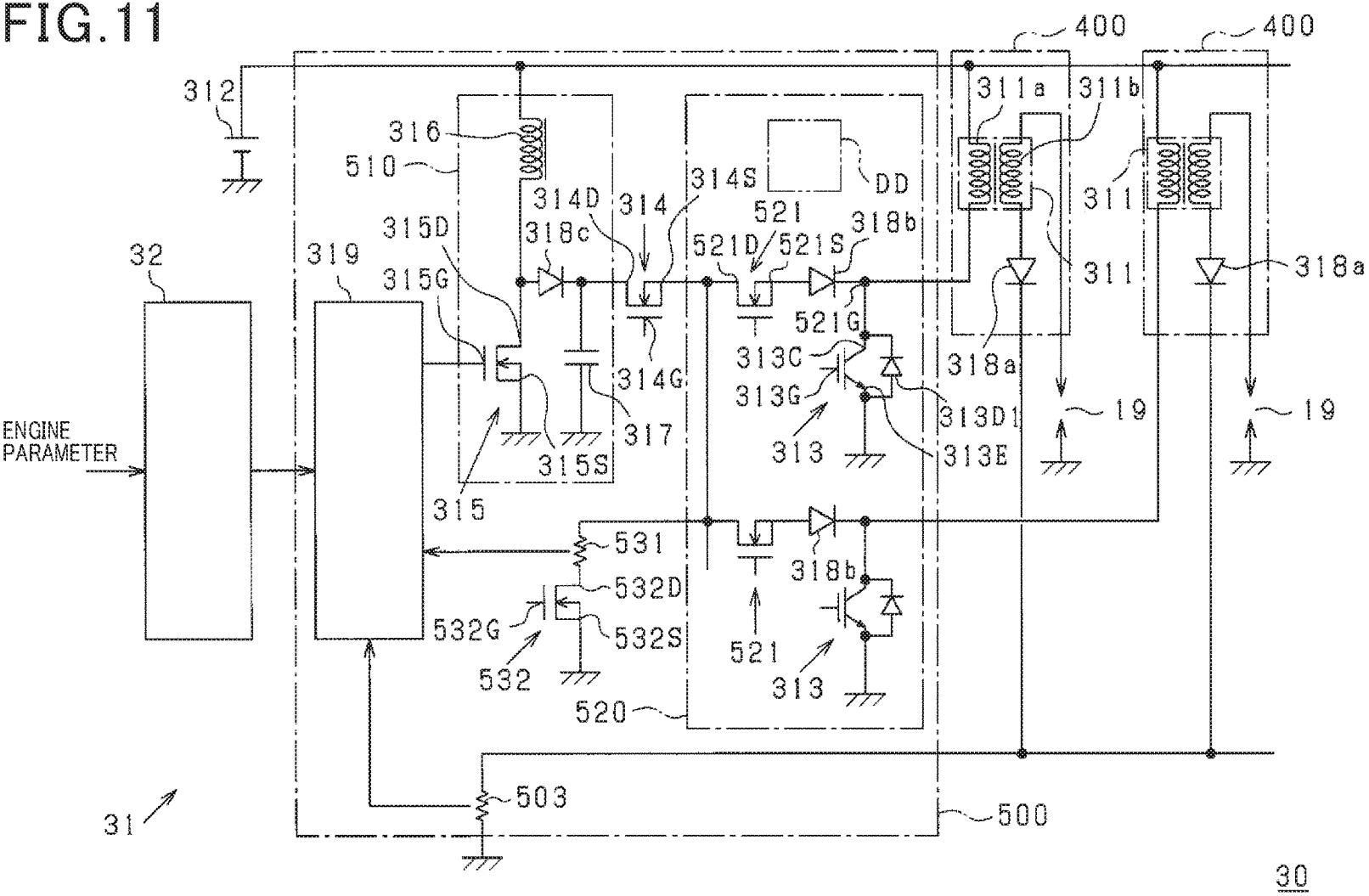
FIG. 11 is a schematic circuit diagram showing a modification of the circuit configuration shown in FIG. 10.

As shown in FIG. 11, the fourth switching element 521 may be provided between the second switching element 314 and the diode 318*b*. That is, the connection point between the second ground side terminal 314S of the second switching element 314 and the fourth power side terminal 521D of the fourth switching element 521 may be connected to the ground side via the additional resistor 531 and the additional switch 532.

The circuit configuration shown in FIG. 11 differs from the circuit configuration shown in FIG. 10 in that the fourth switching element 521 is not interposed between the primary winding 311*a* of the ignition coil 311 and the first switching element 313. Hence, unlike the example shown in FIG. 10, the fourth switching element 521 may be turned on in synchronization with the on timing of the energy input period signal IGw (at the timing simultaneous with or slightly earlier than the on timing of the energy input period signal IGw).

Note that, as indicated by virtual lines (two dot lines) in FIGS. 10 and 11, in the distribution unit 520, a cylinder distribution driver DD may be provided which is a driver circuit for outputting a movement control signal to the fourth switching element 521.

In addition, presence and absence of the occurrence of a short circuit failure of the second switching element 314 is associated with element temperature of the diode 318*b*. Hence, by detecting the element temperature of the diode 318*b* by using temperature characteristics of the forward-direction voltage, it is possible to detect the occurrence of a short circuit failure of the second switching element 314 without using the current detection resistor.

Specifically, for example, the driver circuit 319 makes a constant current flow to the diode 318*b* in a short time immediately after the off timing of the energy input period signal IGw, to acquire the forward-direction voltage of the diode 318*b*. Then, the driver circuit 319 detects the occurrence of a short circuit failure of the second switching element 314, if the acquired value of the forward-direction voltage exceeds a predetermined threshold value.

A plurality of sets including the second switching element 314 and a plurality of groups including the first switching element 313, the fourth switching element 521 and the like connected to the second switching element 314 in parallel may be provided.

Other modifications, which are not particularly described, are definitely included in the technical scope of the present invention within a range which does not change the essential parts of the present invention. In addition, elements configuring means of the present invention for overcoming the problems and expressed in actional and technical manners include specific configurations disclosed in the above embodiments and modifications and equivalents thereof, in addition to any configuration which can realize the actions and functions.

The ignition control apparatus (30) according to the present embodiment controls the operation of an ignition plug (19). Herein, the ignition plug (19) ignites an air-fuel mixed gas in a cylinder (11*b*) of an internal combustion engine (11). The ignition control apparatus of the present embodiment includes an ignition coil (311), a DC power supply (312), a first switching element (313), a second switching element (314), a third switching element (315), and an energy accumulation coil (316).

The ignition coil is provided with a primary winding (311*a*) and a second winding (311*b*). The second winding is connected to the ignition coil. The ignition coil is configured so as to generate a secondary current in the secondary winding by increase and decrease of the primary current (current flowing to the primary winding). In addition, a non-ground side output terminal of the DC power supply is connected to one end side of the primary winding so that the primary current is made to pass through the primary winding.

The first switching element is configured of a semiconductor switching element provided with a first control terminal (313G), a first power side terminal (313C), and a first ground side terminal (313E), the semiconductor switching element controlling on and off states of current supply between the first power side terminal and the first ground side terminal based on a first control signal inputted to the first control terminal, the first power side terminal being connected to the other end side of the primary winding, the first ground side terminal being connected to a ground side.

The second switching element is configured of a semiconductor switching element provided with a second control terminal (314G), a second power side terminal (314D), and a second ground side terminal (314S), the semiconductor switching element controlling on and off states of current supply between the second power side terminal and the second ground side terminal based on a second control signal inputted to the second control terminal, the second ground side terminal being connected to the other end side of the primary winding.

The third switching element is configured of a semiconductor switching element provided with a third control terminal (315G), a third power side terminal (315C), and a third ground side terminal (315E), the semiconductor switching element controlling on and off states of current supply between the third power side terminal and the third ground side terminal based on a third control signal inputted to the third control terminal, the third power side terminal being connected to the second power side terminal of the second switching element, the third ground side terminal being connected to the ground side.

The energy accumulation coil is configured of an inductor, the inductor being interposed in a power line connecting the non-ground side output terminal of the DC power supply and the third power side terminal of the third switching element, the energy accumulation coil accumulating energy therein in response to turning on of the third switching element.

In the ignition control apparatus according to the present embodiment having the above configuration, the primary current flows to the primary coil by turning on of the first switching element. As a result, the ignition coil is charged. Subsequently, if the first switching element is turned off, the primary current which has flowed to the primary coil is suddenly shut off. Then, a high voltage is generated in the primary winding of the ignition coil, and the high voltage is further increased in the secondary winding. Thereby, a high voltage is generated in the ignition plug to generate discharge. In this time, the larger secondary current is generated in the secondary winding. Hence, ignition discharge is started in the ignition plug 19.

Herein, after the ignition discharge is started in the ignition plug, the second current (referred to as "discharge current") approaches zero with time if nothing is done. In this regards, in the configuration of the present embodiment, by turning on the second switching element during the ignition discharge, energy is supplied from the other end side to the primary coil via the second switching element. Then, the primary current flows to the primary coil. At this time, an additional current accompanying the flow of the primary current is superimposed on the primary current which has flowed. Then, the current flowing to the primary current is reinforce, which can generate induced electromotive force equal to or more than the sustaining discharge voltage to the secondary winding. As a result, the discharge current can be desirably secured so as to maintain the ignition discharge.

Therefore, according to the present embodiment, the occurrence of the so-called blow off and the accompanying ignition energy loss can be desirably suppressed by a simplified configuration of the apparatus. In addition, by inputting energy from the side of the low voltage (the side of the ground or the side of the first switching element) of the primary winding as described above, energy can be inputted at lower voltage, compared with the energy inputted from the side of the secondary winding. In this regard, if energy is inputted from the high voltage side of the primary winding at a voltage higher than that of the DC power supply, the efficiency becomes lower due to the current flowing into the DC power supply or the like. In contrast, according to the present embodiment, as described above, since energy is inputted from the side of the low voltage of the primary winding, an excellent advantage can be provided that energy can be inputted most easily and efficiently.

DESCRIPTION OF THE SYMBOLS

11 . . . engine, 11*b* . . . cylinder, 19 . . . ignition plug, 30 . . . ignition control apparatus, 31 . . . ignition circuit unit, 31 . . . electric control unit, 311 . . . ignition coil, 311*a* . . . primary coil, 311*b* . . . secondary coil, 312 . . . DC power supply, 313 . . . first switching element, 313C . . . first power side terminal, 313E . . . first ground side terminal, 313G . . . first control terminal, 314 . . . second switching element, 314D . . . second power side terminal, 314G . . . second control terminal, 314S . . . second ground side terminal, 315 . . . third switching element, 315C . . . third power side terminal, 315E . . . third ground side terminal, 315G . . . third control terminal, 316 . . . energy accumulation coil, 317 . . . capacitor, 319 . . . driver circuit, IGa . . . first control signal, IGb . . . second control signal, IGc . . . third control signal, IGt . . . ignition signal, IGw . . . energy input period signal.

The invention claimed is:

1. An ignition control apparatus for controlling operation of an ignition plug provided so as to ignite an air-fuel mixed gas, the ignition control apparatus comprising:

an ignition coil provided with a primary winding which allows a current to pass as a primary current therethrough and a second winding connected to the ignition coil, an increase and a decrease in the primary current generating a secondary current passing through the secondary winding;

a DC power supply provided with a non-ground side output terminal, the non-ground side output terminal being connected to one end of the primary winding so that the primary current is made to pass through the primary winding;

a first switching element configured of a semiconductor switching element provided with a first control terminal, a first power side terminal, and a first ground side terminal, the semiconductor switching element controlling on and off states of current supply between the first power side terminal and the first ground side terminal based on a first control signal inputted to the first control terminal, the first power side terminal being connected to the other end side of the primary winding, the first ground side terminal being connected to a ground side;

a second switching element configured of a semiconductor switching element provided with a second control terminal, a second power side terminal, and a second ground side terminal, the semiconductor switching element controlling on and off states of current supply between the second power side terminal and the second ground side terminal based on a second control signal inputted to the second control terminal, the second ground side terminal being connected to the other end side of the primary winding;

a converter unit connected to the DC power supply and the second switching element; and a controller that performs control to discharge energy from the converter unit by on operation of the second switching element during ignition discharge of the ignition plug which is started by off operation of the first switching element, to supply the primary current from the other end side to the primary winding.

2. The ignition control apparatus according to claim 1, wherein the converter unit comprises:

a third switching element configured of a semiconductor switching element provided with a third control terminal, a third power side terminal, and a third ground side terminal, the semiconductor switching element controlling on and off states of current supply between the third power side terminal and the third ground side terminal based on a third control signal inputted to the third control terminal, the third power side terminal being connected to the second power side terminal of the second switching element, the third ground side terminal being connected to the ground side; and an energy accumulation coil configured of an inductor, the inductor being interposed in a power line connecting the non-ground side output terminal of the DC power supply and the third power side terminal of the third switching element, the energy accumulation coil accumulating energy therein in response to turning on of the third switching element.

3. The ignition control apparatus according to claim 2, further comprising a capacitor connected in series to the energy accumulation coil between the non-ground side output terminal of the DC power and the ground side, the capacitor accumulating therein energy in response to an off state of the third switching element.

4. The ignition control apparatus according to claim 3, wherein the controller controls the second switching element and the third switching element, wherein the third switching element is turned off and the second switching element is turned on during an ignition discharge of the ignition plug so that the accumulated energy is discharged from the capacitor to supply the primary current to the primary winding, the ignition discharge being started by turning off of the first switching element.

5. The ignition control apparatus according to claim 1, wherein the first switching element includes a diode having a cathode and an anode, the cathode being connected to the first power side terminal, the anode being connected to the first ground side terminal.

6. The ignition control apparatus according to claim 1, wherein the apparatus further comprises a shut-off switch interposed in a current path between the primary coil and the first switching element, the shut-off switch being able to shut-off the current path.

7. The ignition control apparatus according to claim 1, wherein the apparatus further comprises another switching element interposed in a current path between the primary coil and the second ground side terminal of the second switching element; and an additional switch interposed between the second ground side terminal and the ground side, wherein the apparatus further comprises a plurality of groups including the ignition plug, the ignition coil, the first switching element, and the another switching element.

8. The ignition control apparatus according to claim 7, wherein the apparatus further comprises a failure detection resistor connected to the additional switch at a position of a side of the current path with respect to the additional switch.

9. The ignition control apparatus according to claim 7, wherein a plurality of the switching elements are connected to the single second switching element.

* * * * *